United States Patent [19]

Zwicker et al.

[11] Patent Number: 5,046,102

[45] Date of Patent: Sep. 3, 1991

[54] HEARING AID WITH ADJUSTABLE FREQUENCY RESPONSE

[75] Inventors: Eberhard Zwicker, Icking; Thomas Beckenbauer, Munich; Guenther Beer, Erlangen, all of Fed. Rep. of Germany

[73] Assignee: Siemens Aktiengesellschaft, Munich, Fed. Rep. of Germany

[21] Appl. No.: 918,468

[22] Filed: Oct. 14, 1986

[30] Foreign Application Priority Data

Oct. 16, 1985 [DE] Fed. Rep. of Germany ..... 3536881

[51] Int. Cl.[5] ..... H04R 25/00

[52] U.S. Cl. ..... 381/68.2; 381/68; 381/68.4

[58] Field of Search ..... 381/68, 68.2, 68.4

[56] References Cited

U.S. PATENT DOCUMENTS

| | | | |
|---|---|---|---|
| 3,928,733 | 12/1975 | Hueber | 381/94 |
| 4,119,814 | 10/1978 | Harless | 381/68.2 |
| 4,419,544 | 12/1983 | Adelman | 381/68.4 |
| 4,441,202 | 4/1984 | Tong et al. | 381/68 |
| 4,454,609 | 6/1984 | Kates | 381/68 |
| 4,475,230 | 10/1984 | Fukuyama et al. | 381/68 |
| 4,596,902 | 6/1986 | Gilman | 381/68.2 |

FOREIGN PATENT DOCUMENTS

| | | | |
|---|---|---|---|
| 0076687 | 4/1983 | European Pat. Off. | 381/68 |
| OS3027953 | 2/1982 | Fed. Rep. of Germany . | |

OTHER PUBLICATIONS

"Uber Ein Einfaches Funktionsschema Des Gehors", von E. Zwicker, Acustica, vol. 12 (1962), pp. 22-28.

"Beitrag zur automatischen Erkennung gesprochener Ziffern", Terhardt, Kybernetic, vol. 3, No. 3, Sep. 1966, pp. 136-143.

PCT WO83/02212 Bisgaard, Peter et al., "Method and Apparatus for Adapting the Transfer Function in a Hearing Aid", Jun. 23, 1983.

*Primary Examiner*—Jin F. Ng

*Assistant Examiner*—Jason Chan

*Attorney, Agent, or Firm*—Hill Van Santen, Steadman & Simpson

[57] ABSTRACT

A hearing aid has a sound-receiving microphone from which an incoming signal is supplied to a number of different channels, each channel being allocated to a different frequency range within a total expected range of frequencies for the incoming signal. Each channel includes a circuit for measuring the strength of the signal within the frequency range for that channel and for changing the respective strengths of the signals in the other channels by suppressing weak signal channels in favor of strong signal channels.

18 Claims, 2 Drawing Sheets

HEARING AID WITH ADJUSTABLE FREQUENCY RESPONSE

BACKGROUND OF THE INVENTION

1. Field of the Invention

The present invention relates to hearing aids for use by hearing-impaired persons, and in particular to a hearing aid having an adjustable frequency response.

2. Description of the Prior Art

Hearing aids are known which include a plurality of frequency selecting channels connected to the output of a microphone which receives incoming audio signals. Such hearing aids are described, for example, in German OS 30 27 953, Published European Application 00 76 687 and Published PCT Application 83/02212. In German OS 30 27 953, for example, frequency responses are set during a testing phase, the hearing aid then operating according to this frequency response during subsequent use. The selected frequency response may be, for example, that of a conversation partner.

European Published Application 00 76 687 discloses a similar hearing aid which also includes two sets of bandpass filters. In the testing mode, the desired frequency response is filtered out by the first of the two sets of bandpass filters. The second set of bandpass filters, dependent upon the operation of the first set, is then set such that frequencies in the range of voices are preferentially influenced. The hearing aid automatically tunes during subsequent use to the previously selected frequency spectrum. The wearer of the hearing aid, for example, may concentrate entirely on the conversation partner, whose frequency spectrum is preferentially filtered out of the ambient noises by the hearing aid particularly in an extremely loud environment.

In the hearing aid disclosed in PCT Published Application 83/02212, each frequency channel operates according to a respective stored dynamic characteristic. The signal is influenced by means of dynamic compression.

It is known that hearing-impaired persons have a reduced time resolution capability. Because of slower signal decay times associated with hearing-impaired persons, adequate speech resolution cannot be achieved by such persons without auxiliary means.

SUMMARY OF THE INVENTION

It is an object of the present invention to provide a hearing aid for hearing-impaired persons which has selectable frequency response for suppressing weaker channels and emphasizing stronger channels of different frequencies within a given frequency range.

The above object is achieved in accordance with the principles of the present invention in a hearing aid having a compensation circuit for each channel. The channels have respective bandpass filters so that each channel represents a selected frequency range within a total frequency range expected of the incoming signal. The compensation circuit for each channel measures the strength of the signal for that channel as well as the signals from all of the other channels and the outputs of all of the channels are combined such that stronger signal channels are emphasized and weaker signal channels are suppressed.

The hearing aid disclosed herein operates by permitting the individual channels of the multi-channel hearing aid to all act upon all of the other channels so that the strongest channels predominate in the combined output signal, whereas the weaker channels are substantially completely suppressed. This insures that that individual channels are occupied with information only in a defined fraction (for example 30%) of the normally required time. The pauses between the information in the individual channels are thus greater than in conventional devices. The information flow is thus better adapted to the poor time resolution of a hearing-impaired person, and speech comprehension is considerably improved.

Channels wherein only the strongest channels predominate at the output whereas the weaker channels are suppressed are generally referred to as inhibition circuits in conjunction with functional models of hearing. Such circuits are generally described, for example, in the article "Ueber ein einfaches Funktionschema des Gehoers," Zwicker, Acustica, Vol. 12 (1962), pages 22–28 and "Beitrag zur automatischen Erkennung gesprochener Ziffern," Terhardt, Kybernetik, Vol. 3, No. 3, September 1966, pages 136–143. In modified form, such circuits can be utilized in hearing aids as described herein.

DESCRIPTION OF THE PREFERRED EMBODIMENTS

Figure 1:
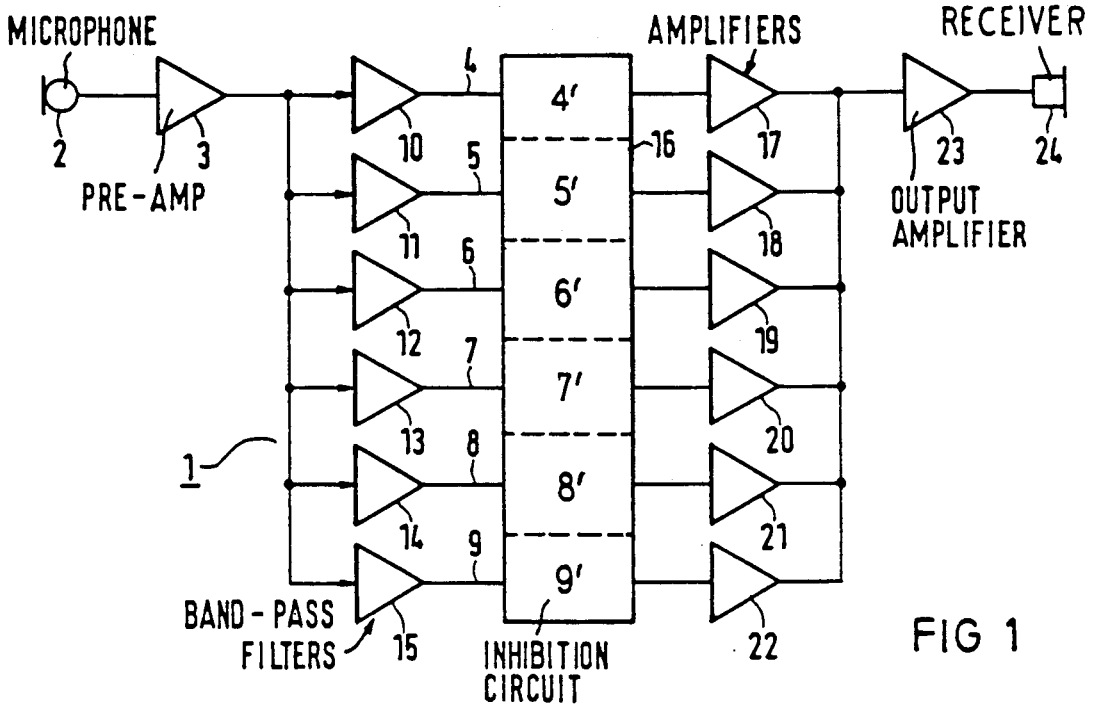
FIG. 1 is a schematic circuit diagram of a hearing aid constructed in accordance with the principles of the present invention.

A hearing aid 1 constructed in accordance with the principles of the present invention is shown in FIG. 1. The hearing aid 1 includes a microphone 2 for sound reception (preferably a directional microphone arrangement). The electrical output signals of the microphone 2 are supplied to a pre-amplifier 3 which may have automatic gain control, and are then supplied to a plurality, for example 6, voice frequency selecting channels 4, 5, 6, 7, 8 and 9. Each voice frequency selecting channel 4 through 9 has a respective bandpass filter 10, 11, 12, 13, 14 or 15. The individual bandpass filters 10 through 15 are graduated in frequency ranges such as according to the following example for the six channel arrangement:

Bandpass filter 10 f=175–350Hz
Bandpass filter 11 f=350–700Hz
Bandpass filter 12 f=700–1050Hz
Bandpass filter 13 f=1050–1600Hz
Bandpass filter 14 f=1600–3200Hz
Bandpass filter 15 f=3200–6400Hz The edge steepness of the bandpass filters may be selected down to 12 dB per octave. The outputs of each of the filters 10 through 15 for the channels 4 through 9 are supplied to an inhibition circuit 16, having respective sub-circuits 4' through 9' for each channel, one such sub-circuit 4' being described in greater detail below in connection with FIG. 2. The inhibition circuit 16 enables strong signals to be emphasized and weak signals to be suppressed taking the signal strengths in all channels into consideration. The outputs of each channel from the inhibition circuit 16 are supplied to amplifiers 17, 18, 19, 20, 21 and 22. The outputs of those amplifiers are supplied in common to an output amplifier 23 which is connected to a receiver 24. The receiver 24 is disposed in the outer ear of a hearing-impaired person such as, for example, by an ear mold. The receiver 24 may alternatively be directly seated in the auditory channel of the hearing-impaired person. For binaural operation, a further hearing aid identical to the hearing aid 1 can be used for the other ear of the hearing-impaired person.

Figure 1A:
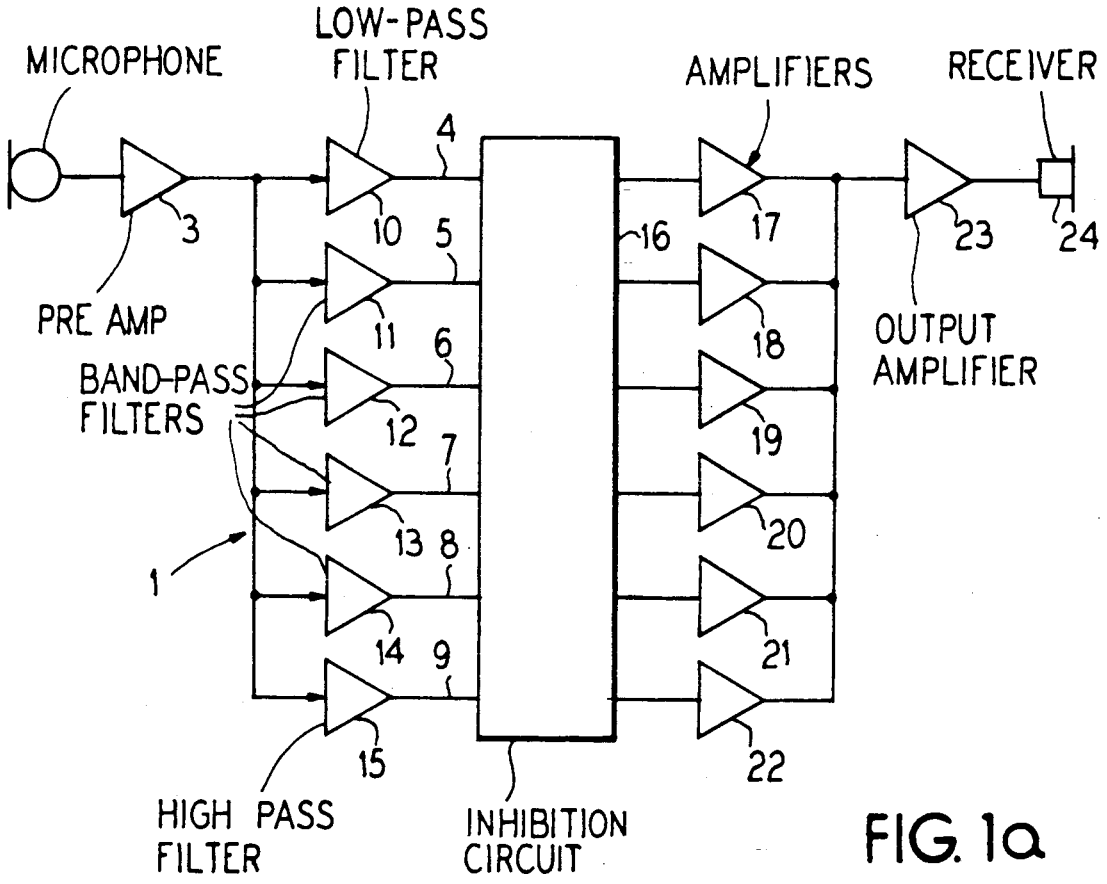
FIG. 1*a* is a schematic circuit diagram of a portion of the hearing aid shown in FIG. 1 in an alternative embodiment.

As shown by the exemplary frequency ranges above, the channels in the center of the total frequency range are smaller than that of the remaining channels. As a further alternative shown in FIG. 1*a*, the channel having the lowest frequency range may have a low pass filter 10' instead of a bandpass filter, and the channel having the highest frequency range may have a high pass filter 15' instead of a bandpass filter.

The purpose of the inhibition circuit 16 is to influence weak channels by means of strong neighboring channels so that the weak channels are further attenuated to be substantially completely suppressed, so that only the strong channel signals take effect at the output.

Figure 2:
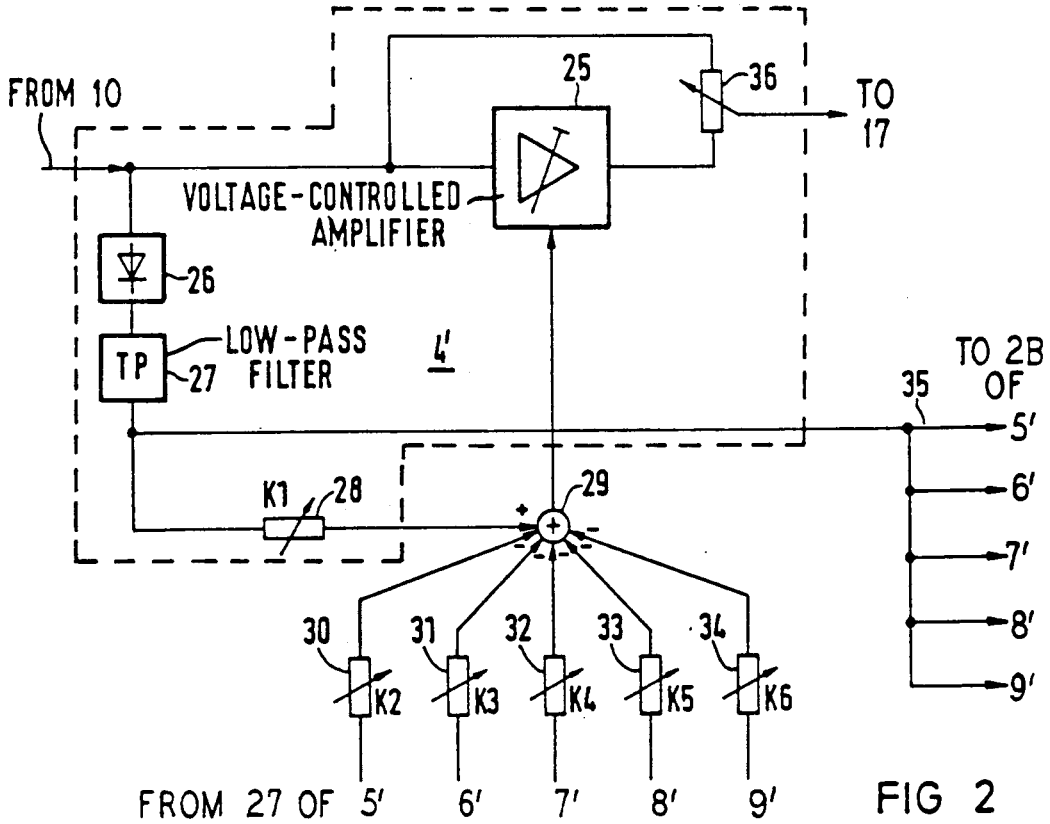
FIG. 2 shows the details of an inhibition circuit for one of the channels of the hearing aid in FIG. 1 and its connection to the other channels.

Further details of the sub-circuit 4' of the inhibition circuit 16 are shown in FIG. 2 for the channel 4. All other channels 5 through 9 have corresponding elements operating in the same manner. As shown in FIG. 2, the sub-circuit 4' has a voltage-controlled amplifier 25. An intermediate signal, such as envelope of a signal entering at the input of the sub-circuit 4', is formed by a diode circuit 26 and a low-pass filter 27, which may have a time constant of, for example, 20 ms. The signal of the envelope is weighted by a factor K1 by a weighting element 28 (for example, a potentiometer or a fixed resistor) and is supplied to the positive input of a summing unit 29. The negative inputs of the summing unit 29 are supplied with the signals corresponding to the envelopes of the remaining channels 5 through 9 with respective weighting factors K2, K3, K4, K5 and K6 respectively determined by weighting elements 30, 31, 32, 33 and 34 (which may also be, for example, potentiometers or fixed resistors). The signal of the envelope from the channel 4 is also conducted to the remaining channels 5, 6, 7, 8 and 9 by signal lines 35. The output signal from the channel 4 is weighted in those remaining channels in the same manner as described above, and is combined with the weighted signals of the neighboring channels in corresponding summing elements for those respective channels.

In the ear model, such as described in the aforementioned articles, the weighting factors are selected so as to simulate a healthy ear. In contrast thereto, the weighting elements in the hearing aid disclosed herein are individually matched to the particular hearing impairment of the persons for whom the hearing aid is intended. This can be accomplished for different hearing-impaired persons by undertaking individual audiometric measurements as is known.

Alternatively, it is possible to provide a uniform presetting of the weighting factors optomized for certain categories of hearing injuries or hearing impairment.

The inhibition circuit 16 can be varied in steps from being ineffective to fully effective in the course of an adaptation process during a longer training phase. The hearing impaired person can thus gradually accustom himself to the speech pattern modified by the inhibition. For this purpose, for example, a potentiometer 36 may be included in each channel within the inhibition circuit 16 for step-by-step modification. Each potentiometer 36 is connected in a feedback loop with the associated voltage-controlled amplifier 25 in the particular channel, as shown in FIG. 2. By varying the resistor (potentiometer) 36 in the feedback loop of the voltage controlled amplifier 25, the user can move in steps from a situation where a particular channel is completely cut out of the combination of inputs supplied to the output amplifier 23 (i.e., is ineffective) to the situation where the full strength of the signal is supplied to the output amplifier 23.

Although modifications and changes may be suggested by those skilled in the art it is the intention of the inventors to embody within the patent warranted hereon all changes and modifications as reasonably and properly come within the scope of their contribution to the art.

We claim as our invention:

1. A hearing aid comprising:

means for receiving incoming audio signals and generating an electrical signal therefrom;

a plurality of frequency selecting channels connected to said means for receiving, said channels respectively transmitting electrical signals in different frequency ranges;

circuit means in each of said channels for generating an intermediate signal corresponding to the strength of the electrical signal in the frequency range for that channel;

means in at least one of said channels for combining said intermediate signals with intermediate signals from the circuit means in each of the other of said channels respectively representing the signal strength of each of the other of said plurality of channels;

means in each channel having a means for combining connected to said means for combining for generating a channel output which increases as the strength of the electrical signal for that channel increases relative to the signal strength of the other channels;

means for combining all of the channel outputs to generate an output signal; and means for supplying said output signal to a hearing-impaired person.

2. A hearing aid as claimed in claim 1, wherein the number of frequency selecting channels is in the range of 3 through 12.

3. A hearing aid as claimed in claim 1, wherein the number of frequency selecting channels is 6.

4. A hearing aid as claimed in claim 1, wherein each frequency selecting channel includes a bandpass filter for selecting the frequency thereof at an input side.

5. A hearing aid as claimed in claim 1, wherein said plurality of frequency selecting channels has a channel of a lowest frequency range, and wherein said channel of a lowest frequency range has a low pass filter at its input side.

6. A hearing aid as claimed in claim 1, wherein said plurality of frequency selecting channels has a channel of a highest frequency range, and wherein said channel of highest frequency range has a high pass filter at its input side.

7. A hearing aid as claimed in claim 1, wherein said means for generating an intermediate signal corresponding to the signal strength in each channel includes means for forming a signal envelope of the signal in the respective channel.

8. A hearing aid as claimed in claim 7, wherein said means for generating a channel output comprises a voltage-controlled amplifier connected to and controlled by the output of said means for combining said intermediate signals.

9. A hearing aid as claimed in claim 8, wherein said means for combining is a summing unit having a positive input which is supplied with the signal for the channel containing said summing unit, and having a plurality of negative inputs respectively supplied with differently weighted signals from the envelopes of the remaining channels in said plurality of channels.

10. A hearing aid as claimed in claim 9, further comprising means for supplying said signal for said envelope of said channel containing said summing unit to all other of said frequency selecting channels for combination in an identical summing unit.

11. A hearing aid as claimed in claim 9, wherein said differently weighted signals of said plurality of channels are weighted based on the hearing-impairment of said hearing-impaired person.

12. A hearing aid as claimed in claim 9, wherein said differently weighted signals are weighted by pre-adjustment for a specific type of hearing impairment.

13. A hearing aid as claimed in claim 1, wherein said audio signal has a total transmission range which is divided into a plurality of frequency ranges by said plurality of frequency selecting channels, and wherein frequency selecting channels in a center of said transmission range have smaller bandwidths than the remaining frequency channels.

14. A hearing aid as claimed in claim 1, wherein said plurality of frequency selecting channels is 6 and wherein said channels have respective frequency ranges of 175–350Hz, 350–700Hz, 700–1050Hz, 1050–1600Hz, 1600–3200Hz and 3200–6400Hz.

15. A hearing aid as claimed in claim 14, wherein each of said frequency ranges is determined by a plurality of bandpass filters respectively in said frequency selecting channels, and wherein the steepness of each bandpass filter is at least 12 dB per octave.

16. A hearing aid as claimed in claim 8, further comprising a variable resistance disposed in a feedback path for said voltage-controlled amplifier for selectively varying the strength of the channel output supplied to said means for combining all of the channel outputs.

17. A hearing aid comprising:

means for receiving incoming audio signals and generating an electrical signal therefrom;

a plurality of frequency selecting channels connected to said means for receiving, said channels respectively transmitting electrical signals in different frequency ranges;

circuit means in each of said channels for generating an intermediate signal corresponding to the strength of the electrical signal in the frequency range for that channel;

means in each channel connected to said circuit means in all of said channels for adding said intermediate signals from all of the channels with the intermediate signal from the channel containing the means for adding being assigned a positive value and all other intermediate signals being assigned a negative value to generate a control voltage;

a voltage controlled amplifier in each channel to which the electrical signal for that channel is supplied, said voltage controlled amplifier generating a channel output from said electrical signal based on said control voltage which increases as the strength of said electrical signal for that channel increases relative to the other channels;

means for combining all of the channel outputs to generate an output signal; and means for supplying said output signal to a hearing-impaired person.

18. A method for operating a hearing aid comprising the steps of:

receiving incoming audio signals and generating an electrical signal therefrom;

transmitting electrical signals in different frequency ranges in a respective plurality of frequency selecting channels;

generating an intermediate signal in each channel corresponding to the strength of the electrical signal in the frequency range for that channel;

combining in at least one of said channels the intermediate signal for that channel with intermediate signals from all of the other channels;

generating a channel output in each channel wherein said intermediate signals are combined which increases as the strength of the electrical signal for that channel increases relative to the signal strengths of the other channels;

combining all of the channel outputs to generate an output signal; and supplying said output signal to a hearing-impaired person.

* * * * *